US009573137B2

(12) United States Patent
Van der Galien

(10) Patent No.: US 9,573,137 B2
(45) Date of Patent: Feb. 21, 2017

(54) COMMINUTOR FOR COMMINUTING BULK MATERIAL, AND METHOD THEREFOR

(71) Applicant: Harmke Van der Galien, Buitenpost (NL)

(72) Inventor: Mark Van der Galien, Buitenpost (NL)

(73) Assignee: EGGERSMANN INGENIEURGESELLSCHAFT MBH, Marienfeld (DE)

( * ) Notice: Subject to any disclaimer, the term of this patent is extended or adjusted under 35 U.S.C. 154(b) by 543 days.

(21) Appl. No.: 14/047,352

(22) Filed: Oct. 7, 2013

(65) Prior Publication Data

US 2014/0103152 A1 Apr. 17, 2014

Related U.S. Application Data

(60) Provisional application No. 61/814,984, filed on Apr. 23, 2013.

(51) Int. Cl.

| | |
|---|---|
| ***B02C 18/00*** | (2006.01) |
| ***B02C 23/16*** | (2006.01) |
| ***B02C 18/16*** | (2006.01) |
| ***B02C 18/18*** | (2006.01) |
| ***B02C 4/34*** | (2006.01) |

(52) U.S. Cl.

CPC ..... *B02C 23/16* (2013.01); *B02C 4/34* (2013.01); *B02C 18/16* (2013.01); *B02C 18/18* (2013.01); *B02C 2018/162* (2013.01); *B02C 2018/188* (2013.01); *B02C 2023/165* (2013.01)

(58) Field of Classification Search

CPC .... B02C 18/16; B02C 18/18; B02C 2018/188; B02C 2018/162; B02C 23/16; B02C 23/10; B02C 2023/165

USPC ..... 241/243, 285.3, 73, 32

See application file for complete search history.

(56) References Cited

U.S. PATENT DOCUMENTS

| | | | | | |
|---|---|---|---|---|---|
| 246,992 | A * | 9/1881 | Anderson | B02C 7/06 | 241/138 |
| 2,756,002 | A * | 7/1956 | Brake | B02C 13/282 | 241/285.3 |
| 3,091,338 | A * | 5/1963 | Nordell | B02C 18/0092 | 210/174 |
| 3,419,223 | A * | 12/1968 | Morin | B02C 18/144 | 241/285.3 |
| 3,703,970 | A * | 11/1972 | Benson | B02C 18/0084 | 241/100 |

(Continued)

FOREIGN PATENT DOCUMENTS

| | | | |
|---|---|---|---|
| DE | 29910772 | U1 | 11/1999 |
| EP | 1442796 | A1 | 8/2004 |

(Continued)

*Primary Examiner* — Faye Francis

(74) *Attorney, Agent, or Firm* — Banner & Witcoff, Ltd.

(57) ABSTRACT

The invention relates to a comminutor for comminuting bulk material, and a trailer and method therefor. The comminutor includes a frame provided with an opening; a rotatable drum which is arranged on the frame and on which blades are provided; counter-blades which are connected to the frame and which operate with the blades for the purpose of comminuting material carried into the opening; a screen positioned on the underside of the drum; and an access door connected to the frame and provided with a tilting mechanism such that easy access to the screen is obtainable by opening the door.

11 Claims, 11 Drawing Sheets

(56) References Cited

U.S. PATENT DOCUMENTS 3,756,519 A * 9/1973 Reynolds ..... B02C 18/14 241/100
3,893,923 A * 7/1975 Rudzinski ..... B01D 33/00 210/161
4,186,888 A * 2/1980 Galanty ..... B02C 18/0092 241/243
4,205,799 A * 6/1980 Brewer ..... B02C 18/184 241/243
4,350,308 A * 9/1982 Brewer ..... B02C 18/184 144/237
4,385,732 A 5/1983 Williams
4,394,983 A * 7/1983 Ulsky ..... B02C 18/146 241/243
4,609,157 A * 9/1986 Thieux ..... B02C 18/148 241/243
4,614,308 A * 9/1986 Barclay ..... B02C 18/0084 241/154
4,690,337 A * 9/1987 Stiefel ..... B02C 18/142 241/167
4,773,600 A * 9/1988 Metski ..... B02C 18/145 241/101.76
4,917,310 A * 4/1990 Carrera ..... B02C 18/14 241/190
5,169,075 A * 12/1992 Galanty ..... B02C 18/16 241/243
5,273,218 A * 12/1993 Burns ..... B02C 18/146 241/189.1
5,553,797 A * 9/1996 Axelsson ..... B02C 18/148 241/285.3
5,562,257 A * 10/1996 Graveman ..... B02C 13/20 241/190
5,746,377 A * 5/1998 Gehrig ..... B02C 18/146 241/242
6,565,026 B1 * 5/2003 Hall ..... B02C 18/145 241/225
7,163,166 B1 1/2007 Smith
7,600,708 B2 * 10/2009 Karlsson ..... B02C 18/144 241/242
8,033,487 B2 * 10/2011 Yamashita ..... B02C 18/146 241/243
8,201,762 B2 * 6/2012 Koslow ..... B02C 13/282 241/188.1
8,464,973 B2 * 6/2013 Karlsson ..... B02C 18/148 241/285.3
2009/0121058 A1 5/2009 Doppstadt et al.

FOREIGN PATENT DOCUMENTS

EP 2045016 A1 4/2009
JP 2004202365 A 7/2004
WO 2010061526 A1 6/2010

* cited by examiner

COMMINUTOR FOR COMMINUTING BULK MATERIAL, AND METHOD THEREFOR

RELATED APPLICATION DATA

This application claims the priority benefit of U.S. Provisional Patent Application No. 61/814,984, filed Apr. 23, 2013, titled "Comminutor for Comminuting Bulk Material, and Method Therefor". This application also claims the priority benefit of NL Patent Application No. 2009580, filed Oct. 5, 2012, titled "Comminutor for Comminuting Bulk Material, and Method Therefor," and the entire disclosure of each of which is hereby incorporated by reference for all purposes.

FIELD

The present invention relates to a comminutor, or a so-called shredder. Such a comminutor is utilized for the purpose of comminuting bulk material, for instance wood.

BACKGROUND

In practice material is reduced in size using comminutors specifically utilized for one type of material. This means that such a comminutor is employed specifically for instance wood. Other types of comminutor are used for other materials. This results in practice in comminutors with limited flexibility of use.

Relatively great forces are necessary for comminuting bulk material. The comminutors hereby have to take a very robust form. The problem that occurs here is the limited accessibility to the comminutor, such as the accessibility to settings for adjusting the comminutor to the bulk material and the desired reduction in size, as well as the accessibility to components in the case of malfunction, repair and maintenance.

SUMMARY

The present invention has for its object to provide an improved comminutor with which the above stated drawbacks are obviated or at least reduced.

This object is achieved with the comminutor for comminuting bulk material according to the invention, wherein the comminutor comprises:

- a frame provided with an opening;
- a rotatable drum which is arranged on the frame and on which blades are provided;
- counter-blades which are connected to the frame and which operate with the blades for the purpose of comminuting material carried into the opening;
- a screen positioned on the underside of the drum; and
- an access door connected to the frame and provided with a tilting mechanism such that easy access to the screen is obtainable by opening the door.

By providing a rotatable drum on which blades are arranged, bulk material carried into the frame of the comminutor is at it were shredded by the co-action of these blades with counter-blades which are preferably disposed fixedly on the frame. By allowing the blades to rotate, material is pressed into the space provided between the blades and the counter-blades. Such blades are also referred to as hammers, blades, combs and so on.

After the comminuting step the comminuted material is carried through a screen. Depending on the screen size, the comminuted material is then discharged or the material is carried along by the drum once again for an additional comminuting operation.

Providing an access door which is provided with a tilting mechanism achieves that relatively easy access can be gained to the interior of the comminutor, and in particular the screen, by opening this door. A door can otherwise be understood to mean any other form of door element, such as a hatch or partition. The door is preferably located on the side of the comminutor and, in the closed position of the door, substantially wholly seals the comminuting space in which the drum is present, while in the opened position access is gained to the diverse components, including particularly the screen as stated above. This has the advantage that a user can exchange the screen for another screen with associated screen size in relatively simple manner. This makes the comminutor according to the invention suitable for application with diverse types of bulk material, including for instance wood, carpet, floor covering, plastic, walls and so on. The bulk material is particularly deferrized here, i.e. iron parts are removed from the introduced bulk material in order to thereby simplify further processing.

Using the adjustable screen size in combination with the currently preferred slowly rotating shredder with a rotation speed in the range of 20 to 40 rpm, and particularly about 30 rpm, it has been found that the comminution of the bulk material can be performed in a single comminuting step. This has the result that a separate pre-comminutor is not required. The comminutor according to the invention hereby provides a universal comminutor suitable for comminuting diverse types of bulk material, wherein access is also gained to the interior parts of the comminutor by means of the door, which in a currently preferred embodiment gives a user access from the ground. This hugely increases the convenience of use and provides a flexibly adjustable comminutor.

In a currently preferred embodiment the tilting mechanism is embodied such that in the opened position substantially the whole door is situated outside the frame. Because the door in opened position is located substantially wholly outside the frame, the door and/or elements mounted thereon can be hoisted away in relatively simple manner using a crane or gripper. Working conditions are hereby considerably improved in the case of a repair, since such a heavy element, on which counter-blades are preferably also mounted, need not be lifted by hand. This increases convenience of use.

In an advantageous preferred embodiment according to the present invention the tilting mechanism is provided with a carrier for lifting and co-displacing the door on the underside as defined in the opened position of the door.

When a carrier is provided, a door element is not only folded open. By also co-displacing the underside, the door element is carried further outward in the opened position. The access of a user is hereby improved and removal of the door element with a crane, for instance for the purpose of maintenance and repair, is also greatly simplified.

In a currently preferred embodiment the carrier is embodied as a hook-like carrier element which hooks behind a half hinge-like element provided on the underside of the door element, which in the closed position rests on a shaft or pin of the frame. Other embodiments are of course also possible.

The tilting mechanism is preferably further provided with a safety element for holding in the opened position the underside of the door co-displaced by the carrier. The safety element prevents the possibility of the door falling out of the comminutor during opening thereof and resulting in dangerous situations. The outward sliding of the door element during opening thereof is in fact bounded by the safety element.

The frame is preferably also further provided with a screen support part which is at least partially displaceable or slidable outward by the tilting mechanism during opening of the door. Allowing the screen support part, on which the screen used in a currently preferred embodiment supports, to slide outward during opening of the door greatly simplifies access to the screen for a user. It is hereby possible in effective manner to exchange a screen and/or remove from the comminutor undesired parts left on the screen. This results in an effective option for adjusting the comminutor according to the invention to the bulk material for comminuting, wherein additional undesired components, for instance iron parts, can be removed from the comminutor in effective manner without causing further damage.

In an advantageous preferred embodiment according to the invention the counter-blades are provided on the door.

Providing the counter-blades on the door achieves on the one hand a stable fixing of the counter-blades relative to the rotating blades. Providing the counter-blades on the door achieves on the other hand that the counter-blades are accessible in relatively simple manner by opening the door.

In a currently preferred embodiment the blades are provided in modular form so that these blades can also be replaced in relatively simple manner in the case of damage or for the purpose of applying the comminutor for other bulk materials.

The door is preferably provided with an adjusting mechanism for adjusting the distance between a blade and a counter-blade. A precise adjustment of the space between the blades and the counter-blades makes it possible to realize a better comminuting or cutting behavior, which is moreover adjustable on the basis of the bulk material on the one hand and the desired comminution size on the other. This can be carried out in effective manner owing to this precise adjustment, whereby the material to be reduced in size will in addition require fewer rotations in the comminutor for an additional comminuting operation. This has the result, among others, of reducing the amount of diesel required when a separate diesel engine is used as a drive. This achieves that the costs and the emission of gases remain minimal.

The adjusting mechanism preferably comprises a blocking means for fixing the door relative to the frame during use. Fixing the door also fixes the counter-blades connected thereto relative to the drum. This has the effect that possible iron parts present among the bulk material cannot press aside the knives and/or blades and result in problems during further processing of the material.

In a further advantageous preferred embodiment according to the present invention the drum is provided with an internal bearing-mounting.

Providing a bearing-mounting in the interior of the drum achieves that a better support of the drum can be realized. This is important in view of the relatively great forces exerted on this drum during comminution of the bulk material. Providing an internal bearing-mounting makes the distance between a left-hand and a right-hand bearing relatively smaller, whereby a possible sagging of the drum will also be smaller. The distance between the blades and the counter-blades is hereby also better maintained, so that an effective comminution can be realized.

The invention also relates to a trailer provided with a comminutor as described above.

Such a trailer provides the same effects and advantages as stated for the comminutor. Using a trailer provided with the above described comminutor a so-called stand-alone installation can be obtained. The trailer is preferably provided here with a separate drive which for instance makes use of a diesel engine and, if desired, a crane or gripper for filling the comminutor with the bulk material for processing. The comminutor according to the invention can hereby be used in effective manner at diverse locations, including remote locations such as in a forest.

The invention further also relates to a method for comminuting bulk material, the method comprising the steps of:

providing a comminutor as described above;

carrying material for comminuting into the opening;

comminuting the material; and discharging the comminuted material.

Such a method provides the same effects and advantages as stated for the comminutor and/or trailer provided therewith as stated.

Further advantages, features and details of the invention are elucidated on the basis of the preferred embodiments thereof, wherein reference is made to the accompanying drawings, in which:

DETAILED DESCRIPTION OF CERTAIN PREFERRED EMBODIMENTS

Figure 1:
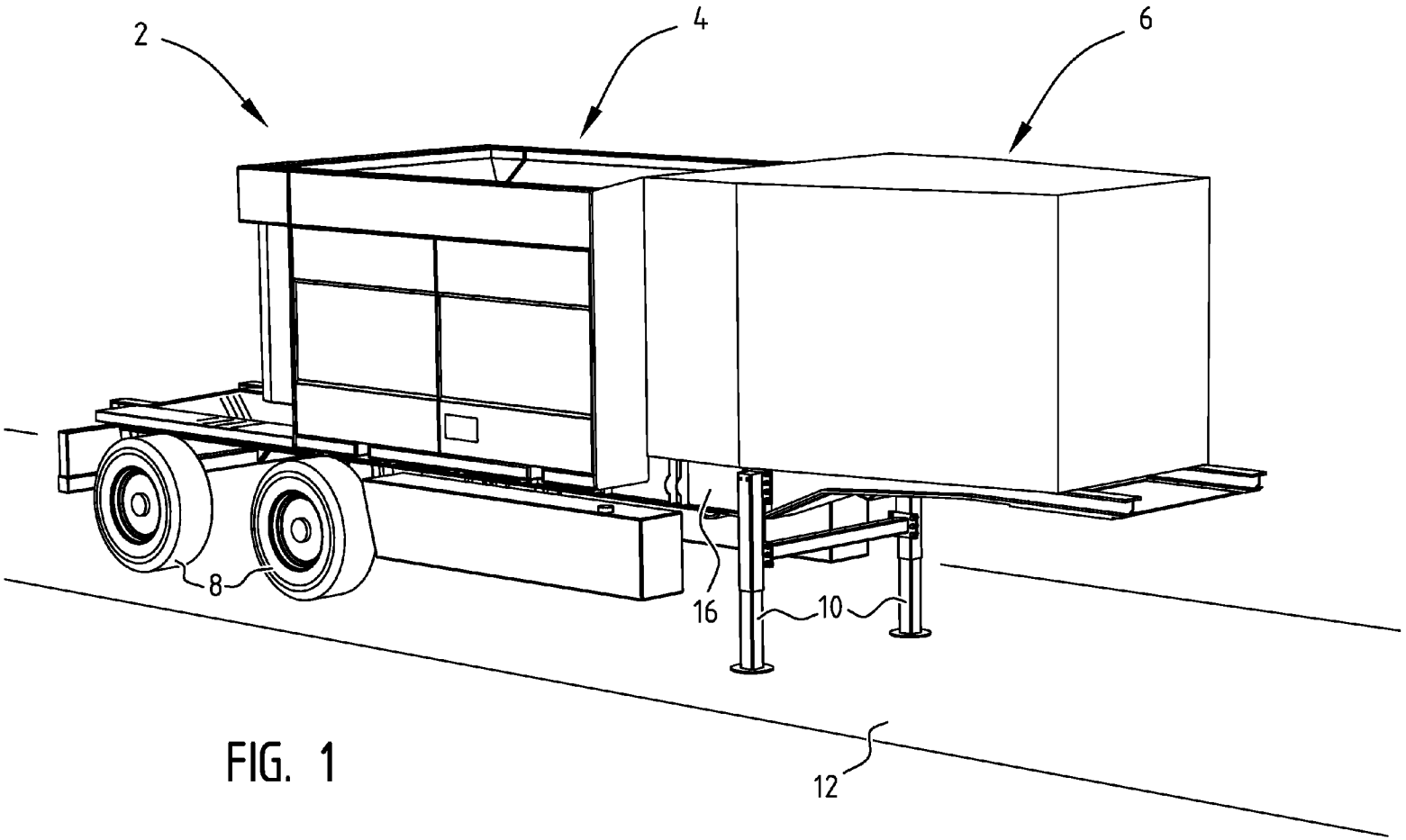
FIG. 1 shows a view of a comminutor according to the invention positioned on a trailer.

A trailer 2 (FIG. 1) is provided with a comminutor or shredder 4. Comminutor 4 is driven with a separate drive 6, in the shown embodiment comprising a diesel engine. Wagon or trailer 2 is placed during use on ground surface 12 using wheels 8 and supports 10.

Figure 2:
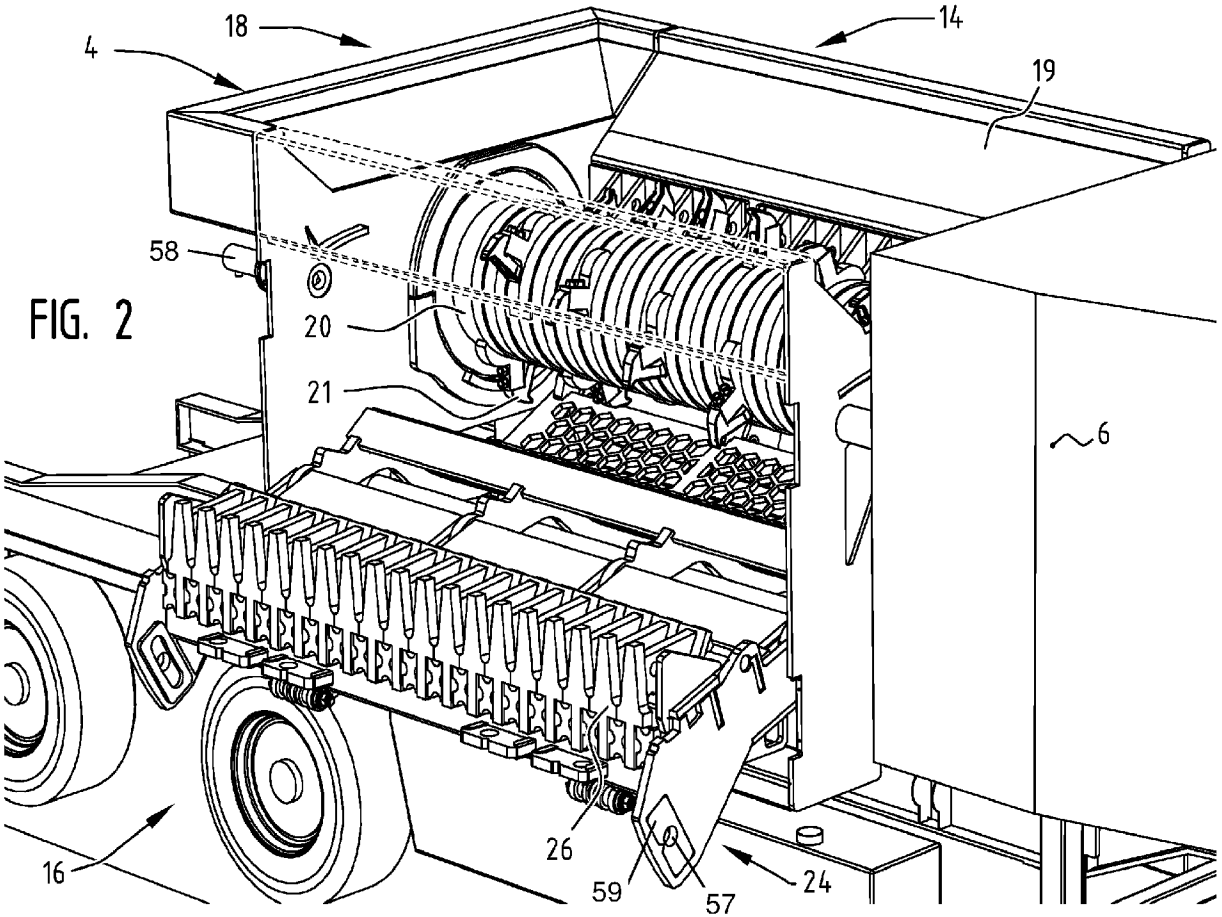
FIG. 2 shows a view of the comminutor of FIG. 1 with an opened door.

Comminutor 4 (FIG. 2) is provided with container or frame 14 which in the shown embodiment can be placed on frame 16 of wagon 2. Provided on the upper side of frame 14 is opening 18 in which a number of inclining feed plates 19 are arranged. Material for comminuting can hereby be fed into the space bounded by frame or container 14 of comminutor 4. Provided in the interior of comminutor 4 is a drum 20 on which a number of blades 22 are arranged. Drum 20 is a rotatable drum. A hatch or door 24 is provided on a side of comminutor 4. In the shown embodiment a number of modular counter-blades 26 are arranged on door 24.

Figure 3:
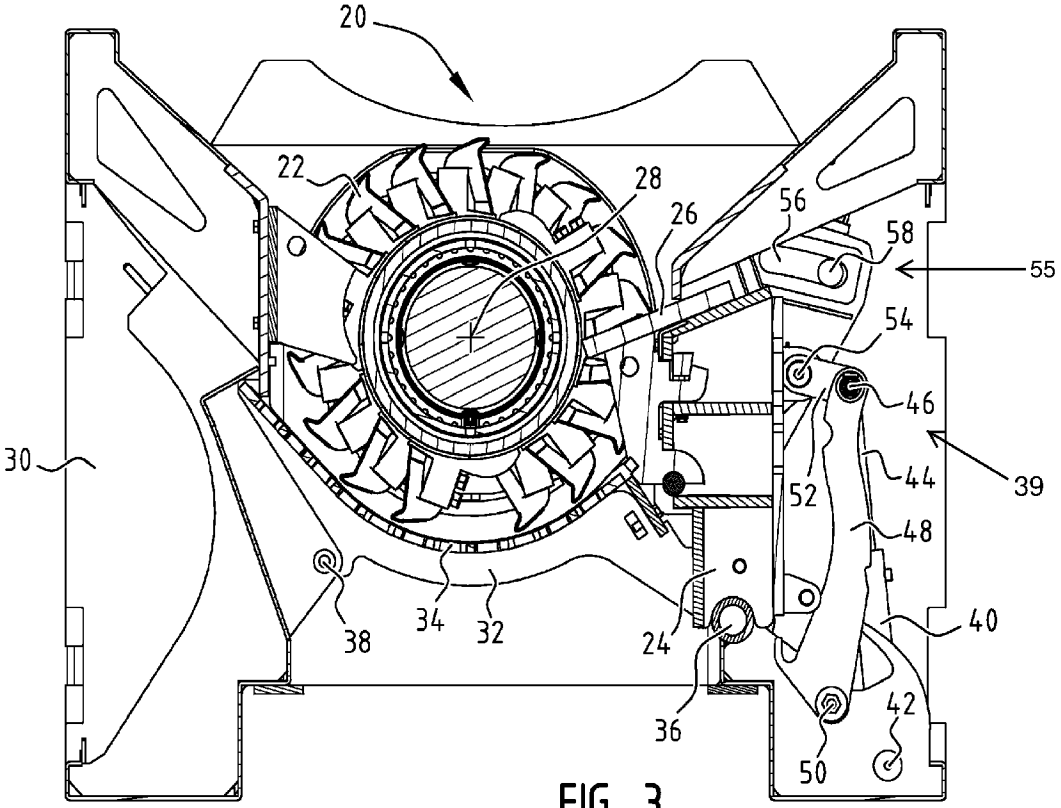
FIGS. 3 and 4 show further views of a comminutor of FIG. 2.
Figure 4:
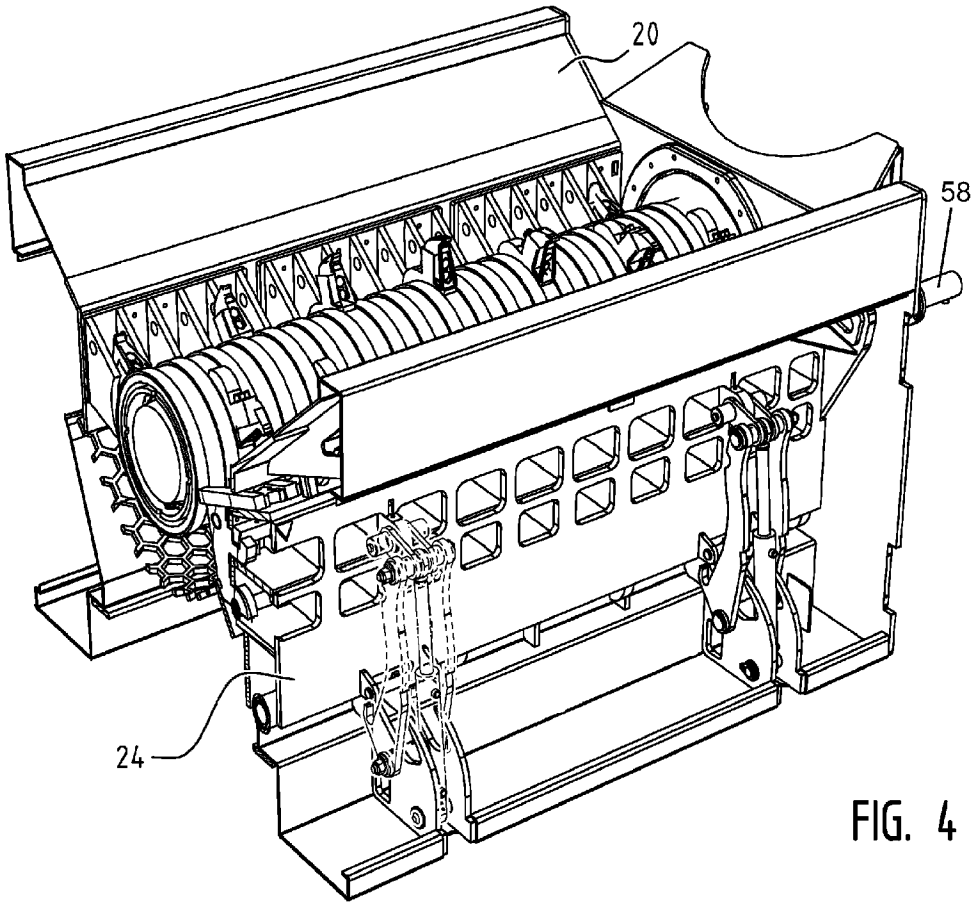

Drum 20 (FIGS. 3 and 4) rotates during use about central axis 28. Blades 22 rotate during use through recesses between adjacent counter-blades 26 so as to thereby bring about the actual comminution of the material. The type of blade 22 and counter-blade 26 can be adapted to the type of material for comminuting and the desired comminution size. On the underside of drum 20 a curved support part 30 is provided on the side walls of comminutor 4 during use. Also provided is a screen support part 32 on which a screen 34 can be placed. Screen support part 32 rests during use on shaft 36 and pin 38. In closed position door 24 likewise rests on shaft 36. Movement of door 24 is realized using a tilting mechanism 39 that includes a cylinder 40, which is mounted at a first mounting point 42, and a cylinder rod 44 on shaft 46. A first arm 48 is also provided between pivot point 50 and shaft 46. Shaft 46 is connected using a second arm 52 to hinge 54 on door 24. Door 24 is provided on the upper side with an adjustment mechanism 55 that includes a slotted hole 56 and a blocking catch 58 that fixes the door in closed position by engaging one of the apertures 57 formed in a plate 59 positioned in door 24. The distance between blades 26 and blades 22 is hereby set and maintained during use.

Figure 5:
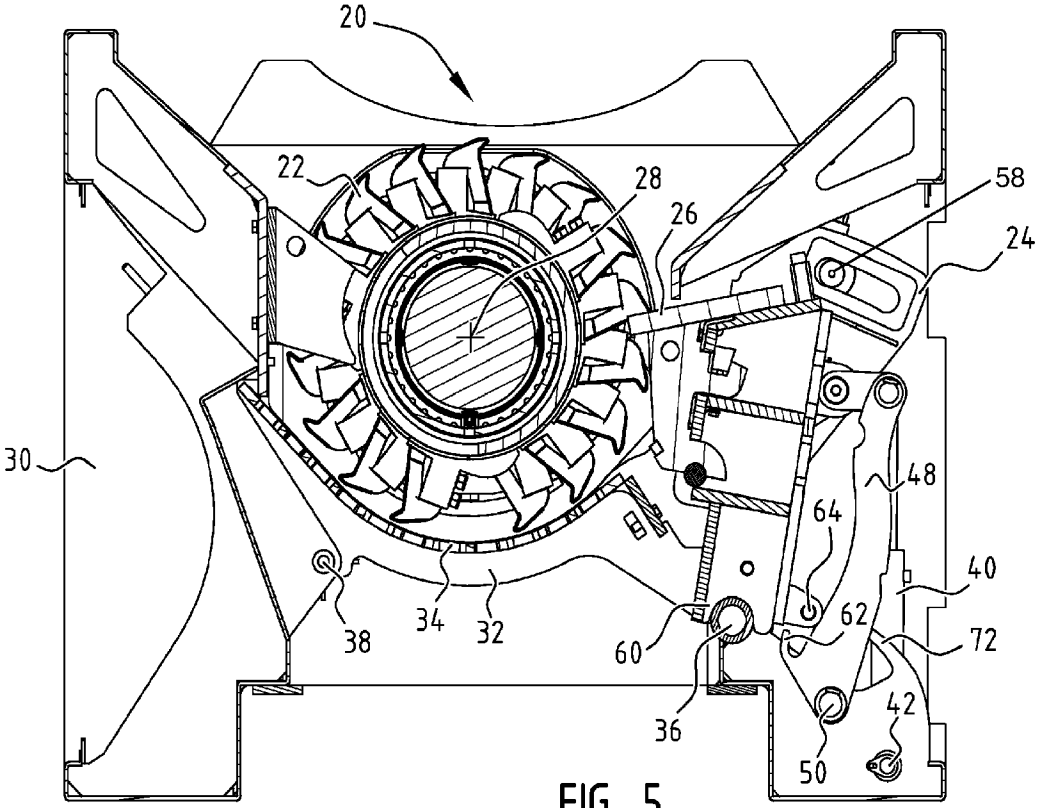
FIG. 5-7 show views of the opening of the door.
Figure 6:
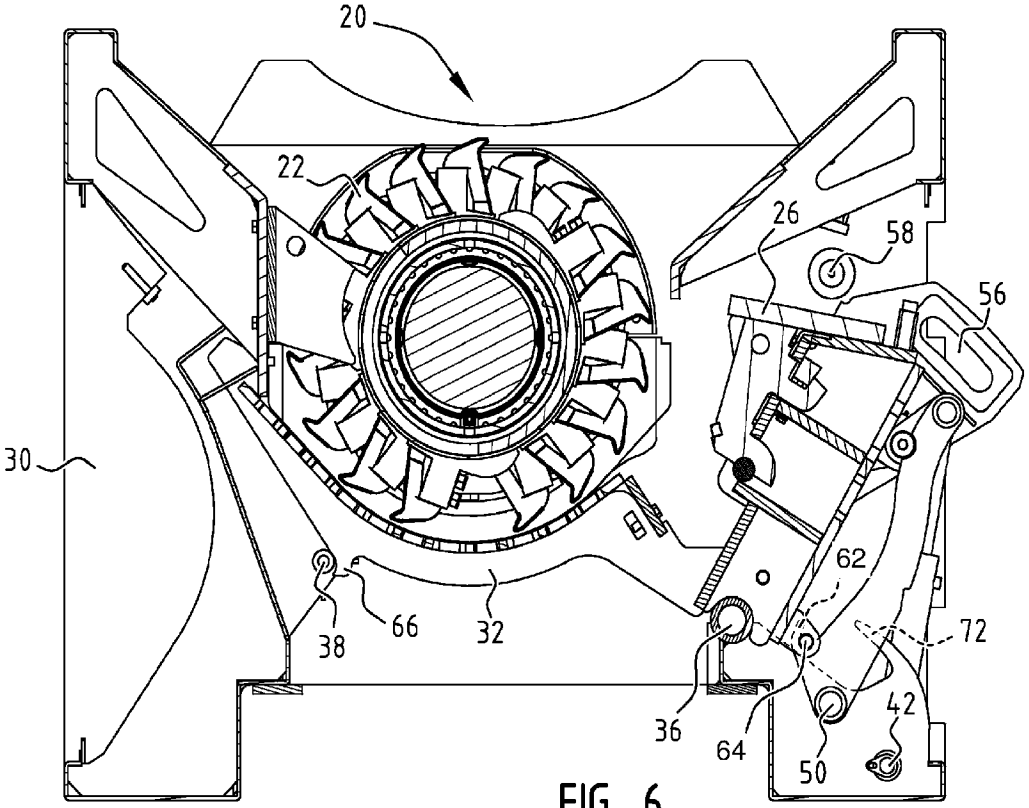
Figure 7:
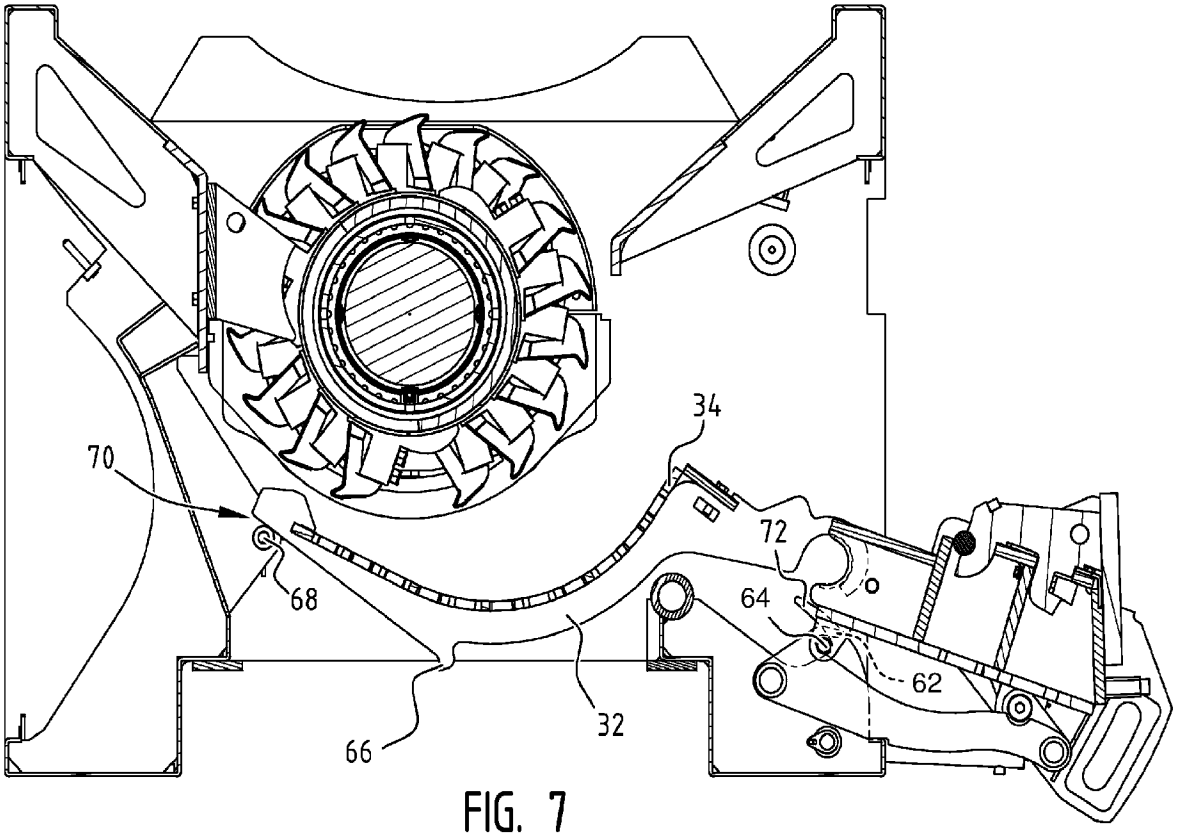

When door 24 is opened (FIG. 5-7) cylinder 40 slides out, whereby cylinder 40 and arm 48 rotate around respective pivot points 42 and 50. In the shown embodiment door 24 will in the first instance rotate about shaft 36 using the half hinge-like element 60. The door moves here from the closed position of FIG. 5 to an intermediate position as in FIG. 6. With further inward sliding of cylinder 40 the carrier or carrier hook 62 provided on arm 48 co-displaces pin 64 provided on the underside of door 24 during the tilting movement so that door 24 is pulled outward and lies substantially outside the frame of comminutor 4 in the opened position (FIG. 7). During this combined tilting and sliding movement of door 24, in the shown embodiment screen support part 32 is pulled outward together with support 34, wherein screen support part 32 no longer rests on pin or shaft 68 with support part 66, but instead with outer end 70. Further provided on a comminutor 4 is safety element or safety hook 72 with which pin or shaft 64 is held in place and cannot therefore simply fall out of comminutor 4 in the opened position.

Figure 8:
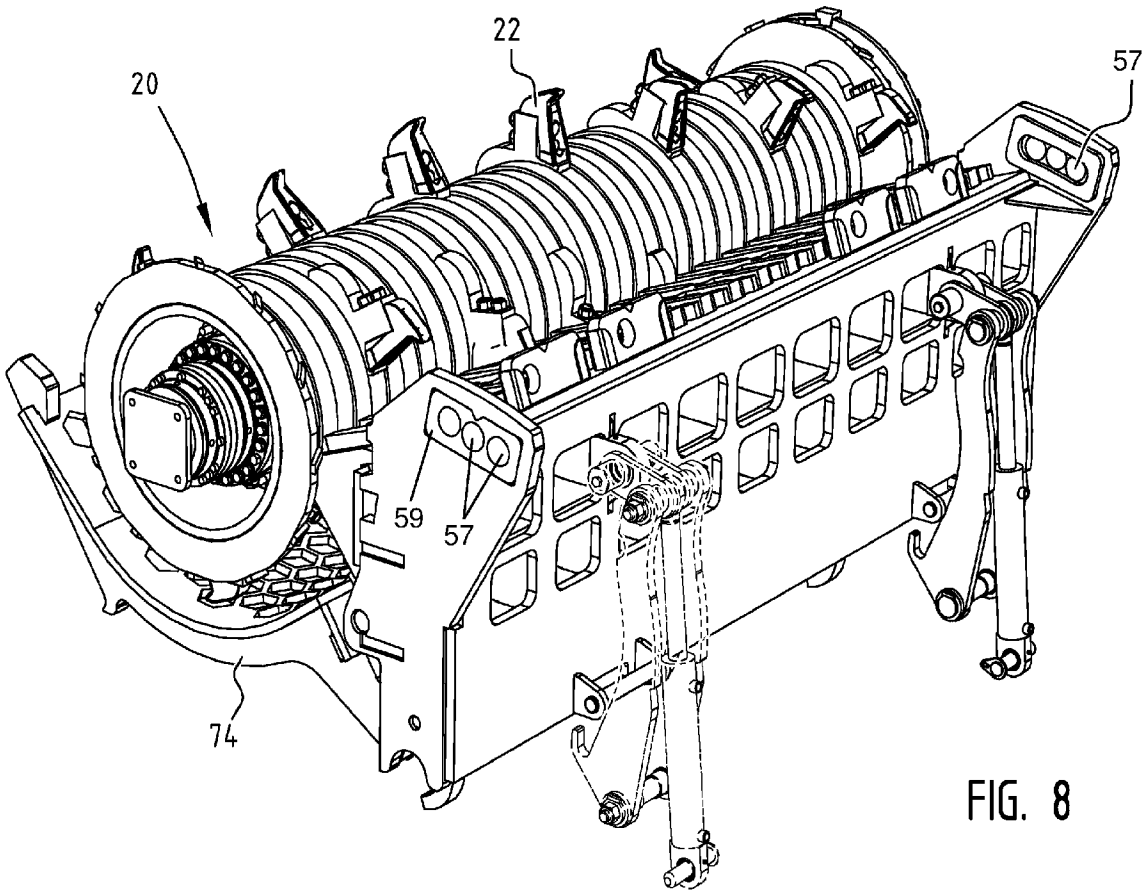
FIG. 8-10 show views of components of the comminutor of FIG. 2.
Figure 9:
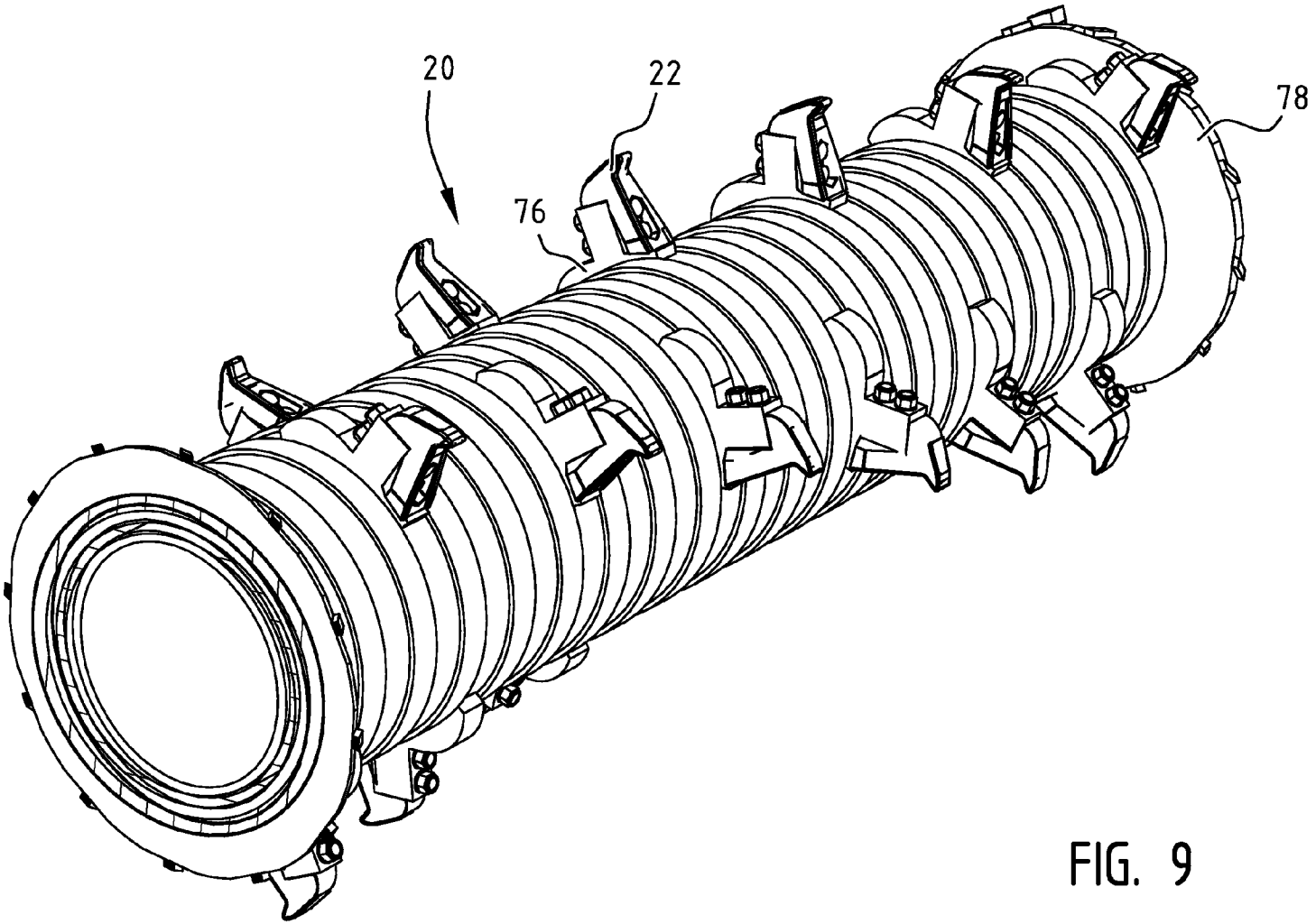
Figure 10:
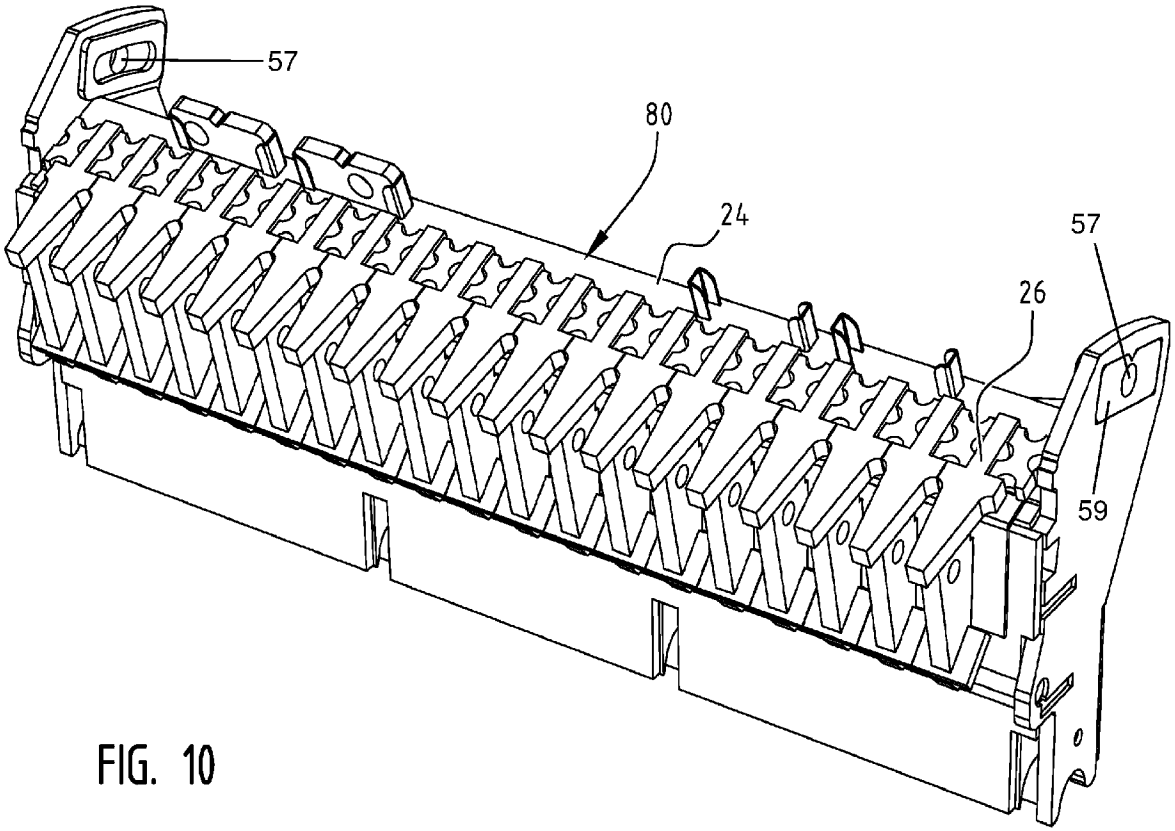
Figure 11:
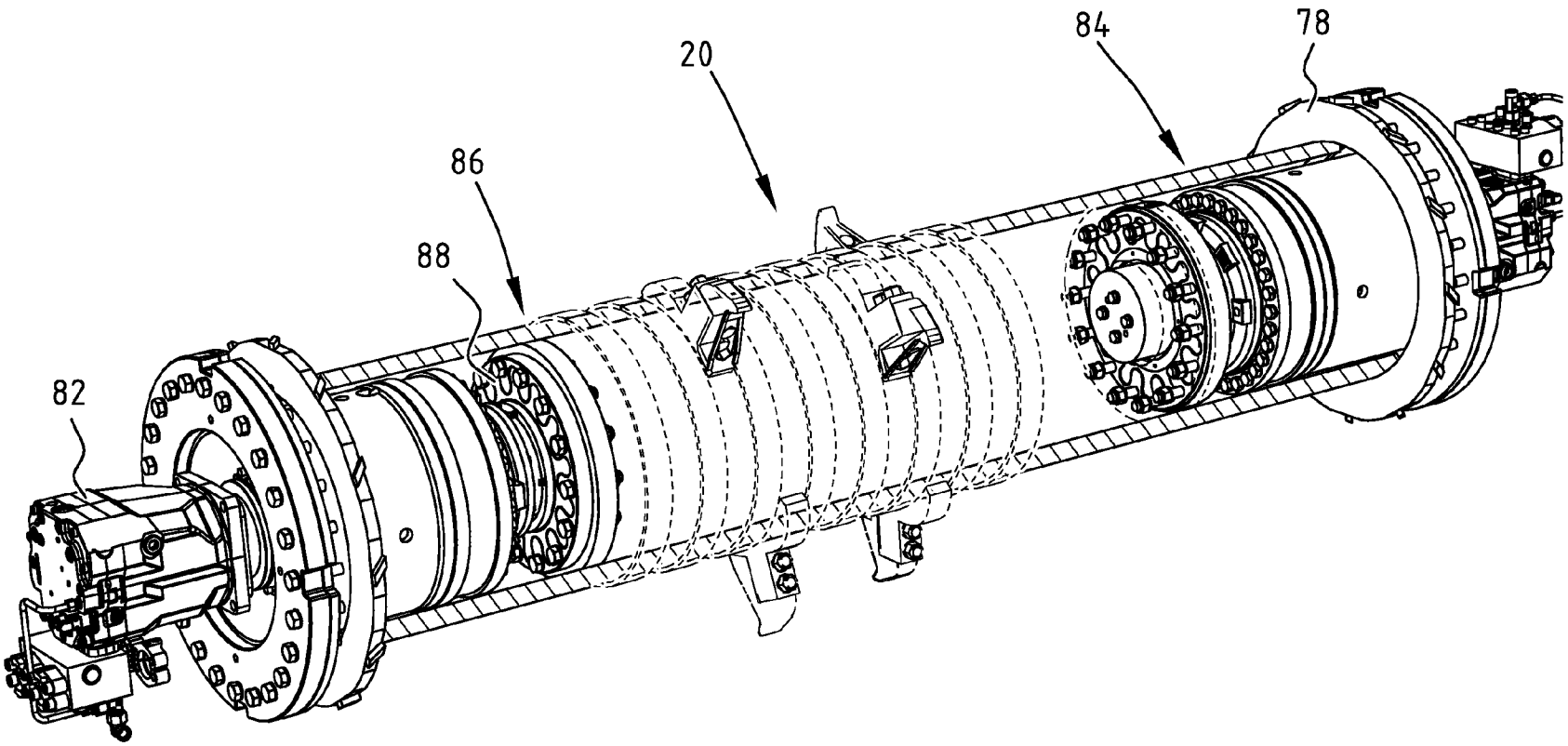
FIG. 11 shows a view of the drum of the comminutor according to FIG. 2.

Screen 74 (FIG. 8) is placed on the side of drum 20 facing downward during use. The positioning of blades 22 is adapted to the material for comminuting (FIG. 8 and FIG. 9). Drum 20 is provided in the shown embodiment with a number of supports 76 on which blades 22 are provided. A flange 78 is provided on the outer ends of drum 20.

Counter-blades 26 are provided in modular manner in recesses 80 arranged in door 24. Counter-blades 26 are hereby easily replaceable.

Drum 20 with flanges 78 is driven from outside using a drive 82. Provided on the inner side of drum 20 is bearing-mounting 84 comprising a flange 86, which is fixedly connected to the inner side of drum 20, and a carrier gear 88. The length of drum 20 between the two support points with flanges 86 is in this way reduced, whereby less outward bending will occur in the case of similar forces.

During use of comminutor 4, material for comminuting is introduced into opening 18, for instance using a crane. Owing to the rotating movement of drum 20, on which blades 22 are arranged, the material for comminuting is shredded between blades 22 and blades 26, which in the shown embodiment are mounted on door 24. On the underside of comminutor 4 the comminuted material is carried over screen 74 with a determined screen size. Screen 74 determines which size of the comminuted material can leave comminutor 4. This material is then discharged. In order to gain access to the interior of comminutor 4, door 24 is opened using cylinder 40. Undesired parts can hereby be removed from screen 74 and/or components, including screen 74 itself, can be replaced in relatively simple manner.

The present invention is by no means limited to the above described preferred embodiments thereof. The rights sought are defined by the following claims, within the scope of which many modifications can be envisaged.

What is claimed is:

1. A comminutor for comminuting bulk material, comprising:
- a frame provided with an opening;
- a rotatable drum which is arranged on the frame and on which blades are provided;
- counter-blades which are connected to the frame and which operate with the blades for the purpose of comminuting material carried into the opening;
- a screen positioned on an underside of the rotatable drum; and
- an access door connected to the frame and provided with a tilting mechanism such that easy access to the screen is obtainable by opening, the door,
- wherein the door is provided with an adjusting mechanism for adjusting the distance between the blades and the counter-blades.

2. The comminutor of claim 1, wherein the tilting mechanism is embodied such that in the opened position substantially the whole door is situated outside the frame.

3. The comminutor of claim 1, wherein the tilting mechanism is provided with a carrier for lifting and co-displacing the door on the underside of the rotatable drum as defined in the opened position of the door.

4. The comminutor of claim 3, wherein the tilting mechanism is further provided with a safety element for holding in the opened position the underside of the door co-displaced by the carrier.

5. The comminutor of claim 3, wherein the frame is further provided with a screen support part which is provided in at least partially outward slidable manner by the tilting mechanism during opening of the door.

6. The comminutor of claim 1, wherein the adjusting mechanism comprises a blocking means for fixing the door relative to the frame during use.

7. The comminutor of claim 1, wherein the drum is provided with an internal bearing-mounting.

8. A comminutor for comminuting bulk material, comprising:
- a frame provided with an opening;
- an access door connected to the frame, provided with a tilting mechanism such that easy access to the screen is obtainable by opening the door;
- a rotatable drum which is arranged on the frame and on which blades are provided;
- counter-blades provided on the door, and which are connected to the frame, and which operate with the blades for the purpose of comminuting material carried into the opening; and
- a screen positioned on the underside of the rotatable drum,
- wherein the access door is provided with an adjusting mechanism for adjusting the distance between the blades and the counter-blades.

9. The comminutor of claim 8, wherein the adjusting mechanism comprises a blocking means for fixing the door relative to the frame during use.

10. A trailer provided with a comminutor as claimed in claim 1.

11. A method for comminuting bulk material, comprising the steps of:
- providing a comminutor as claimed in claim 1;
- carrying material for comminuting into the opening;
- comminuting the material; and
- discharging the comminuted material.

* * * * *